US006338530B1

(12) United States Patent
Gowing

(10) Patent No.: US 6,338,530 B1
(45) Date of Patent: Jan. 15, 2002

(54) LUMBAR SUPPORT DEVICE

(75) Inventor: John P. Gowing, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/608,325

(22) Filed: Jun. 30, 2000

(51) Int. Cl.[7] ..... A47C 3/025; A47C 3/026; A47C 3/027; A47C 7/46

(52) U.S. Cl. ..... 297/284.4; 297/284.7; 297/284.1

(58) Field of Search ..... 297/284.4, 284.1, 297/284.7

(56) References Cited

U.S. PATENT DOCUMENTS 5,397,164 A 3/1995 Schuster et al.
5,651,584 A 7/1997 Chenot et al.
5,911,477 A * 6/1999 Mundell et al. ..... 297/284.4

* cited by examiner

*Primary Examiner*—Carl D. Friedman
*Assistant Examiner*—Chi Nguyen
(74) *Attorney, Agent, or Firm*—Grant D. Kang; Dennis J. M. Donahue, II; Thompson Coburn LLP

(57) ABSTRACT

A lumbar support device includes a flexible grid that can be bowed to provide additional curvature and axially moved on a track. The flexible grid is bowed and moved by brackets on the track in combination with cables and actuators. For bowing the flexible grid, a cable segment pulls a pair of brackets together which bow the flexible grid. The segment is wrapped around one of the brackets and is attached at its ends to the other bracket and an actuator, thereby providing a mechanical advantage to the bowing resistance of the flexible grid. For axially moving the flexible grid, a cable in a fixed bracket directly pulls on the pair of brackets and the flexible grid moves with the pair of brackets; a compression spring is used to provide resistance to the cable and movement in an opposite direction. In another embodiment, a lumbar support device includes a flexible grid that is bowed without any change in axial position. In yet another embodiment, a lumbar support device includes a grid that is moved axially without any change in curvature.

20 Claims, 5 Drawing Sheets

LUMBAR SUPPORT DEVICE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates generally to devices that support the weight of a person in a seated position and particularly to devices that are capable of changing shape according to the occupant, and more particularly, this invention relates to devices that support and change shape according to the lumbar region of the occupant.

2. Related Art

Lumbar support devices have been integrated into seats to change their shape in the lumbar region, thereby allowing each occupant to adjust the support provided by the seat. The curvature and axial location of these devices are traditionally adjustable. When the back of the occupant engages the back of the seat, the curvature of the device presses the seat towards the occupant's spinal column, and the axial location of the device can be positioned according to the size of the occupant, thereby accounting for differences in the occupant's lumbar region with respect to the seat. It is generally known to provide manual actuation means and to alternatively provide powered actuation means for changing the curvature of the lumbar device and for changing the axial location of the lumbar device.

Typically, the curvature portion of these devices is constructed of a rigid material that is stamped into a particular shape or manufactured from individual components attached by hardware, such as rivets, screws, welds and bolts. Curvature changes are accomplished by bowing the curvature portion, usually pulling support structures toward each other. It is well known to pull on the supports with cables and some devices interpose structures between the supports to provide a mechanical advantage to the pulling action. In particular, U.S. Pat. No. 5,397,164 discloses a rod and a lever with springs and traction elements between supports and further discloses a cable running around a groove formed in a support plate in substitution for the lever. By substituting the cable running around the groove for the lever mechanism, the springs and traction elements are eliminated; however, the rod is required for both the lever mechanism and the grooved support plate. Additionally, the designs of these known devices require manual assembly operations, including the manual attachment of extension springs and assemblies requiring rivets or welds, and do not allow for a simplified assembly process.

Lumbar support devices using a resilient grid, such as those disclosed in U.S. Pat. Nos. 5,911,477 and 5,651,584 and incorporated by reference herein, provide good support qualities without excessive parts and are well suited for simplified assembly operations. These lumbar supports could be further improved with novel structures that provide a mechanical advantage and are also well suited for an automated manufacturing process.

SUMMARY OF THE INVENTION

It is in view of the above problems that the present invention was developed. The invention is a lumbar support device that can bow a flexible grid attached to a first bracket and a second bracket that slide on a track. Pulling on a cable segment that link the pair of brackets results in the bowing of the flexible grid. The cable segment is wrapped around the second bracket and is attached at its terminal end to the first bracket and its proximal end is engaged by a curvature cable actuator; wrapping the cable segment provides a mechanical advantage to the bowing resistance of the flexible grid. According to the present invention, the greatest mechanical advantage can be achieved by wrapping the cable segment around a pulley attached to the second bracket, and since no rod is necessary according to the present invention, this mechanical advantage can be achieved with fewer parts than the related art. The lumbar support device can also change the axial position of the flexible grid. A spring tension cable links an integrated bracket with the second bracket, and a compression spring is used to provide resistance to the cable and movement in an opposite direction.

In another embodiment, a lumbar support device includes a flexible grid that is bowed without any change in axial position. In yet another embodiment, a lumbar support device includes a grid that is moved axially without any change in curvature.

The track can be constructed from a base wire, known to be well suited to automatic manufacturing operations according to the patents incorporated by reference above and generally simplifying the assembly process. According to the patents incorporated by reference, it is known to slidably attach a bracket onto the base wire through apertures in the bracket and hold the bracket onto the base wire with bends in the base wire, to secure a bracket to the base wire between a dimple and a bend in the base wire, and to rotatably attach the flexible grid to a pair of brackets with a pair of pivot legs formed on each end of the border elements. Each of these attachments is accomplished using corresponding formations in the structures themselves, thereby eliminating any need for a weld, a rivet, or any other hardware. According to the simplified assembly process of the present invention, the integrated bracket slides onto the track and is secured to the track by a dimple at a fixed position in the track, the compression spring slides onto the track and is held in place between the integrated bracket and a slidably attached bracket, and the integrated bracket is linked with the second bracket using a press-fit connection at the end of the spring tension cable. For a powered lumbar support, the simplified assembly process also includes snap-fit connections between the integrated bracket and respective actuators.

Therefore, it is an object of this invention to provide a lumbar support unit capable of curvature movement having a mechanical advantage that uses fewer parts and hardware than the related art.

It is another object of the present invention to provide a lumbar support unit capable of axial movement that may be assembled with a minimum number of parts and hardware.

It is yet another object of the present invention to provide a lumbar support unit that is well suited to automatic assembly operations.

It is also an object of the present invention to provide a simplified assembly process for a lumbar support unit.

Further features and advantages of the present invention, as well as the structure and operation of various embodiments of the present invention, are described in detail below with reference to the accompanying drawings in which like reference numbers indicate like elements.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
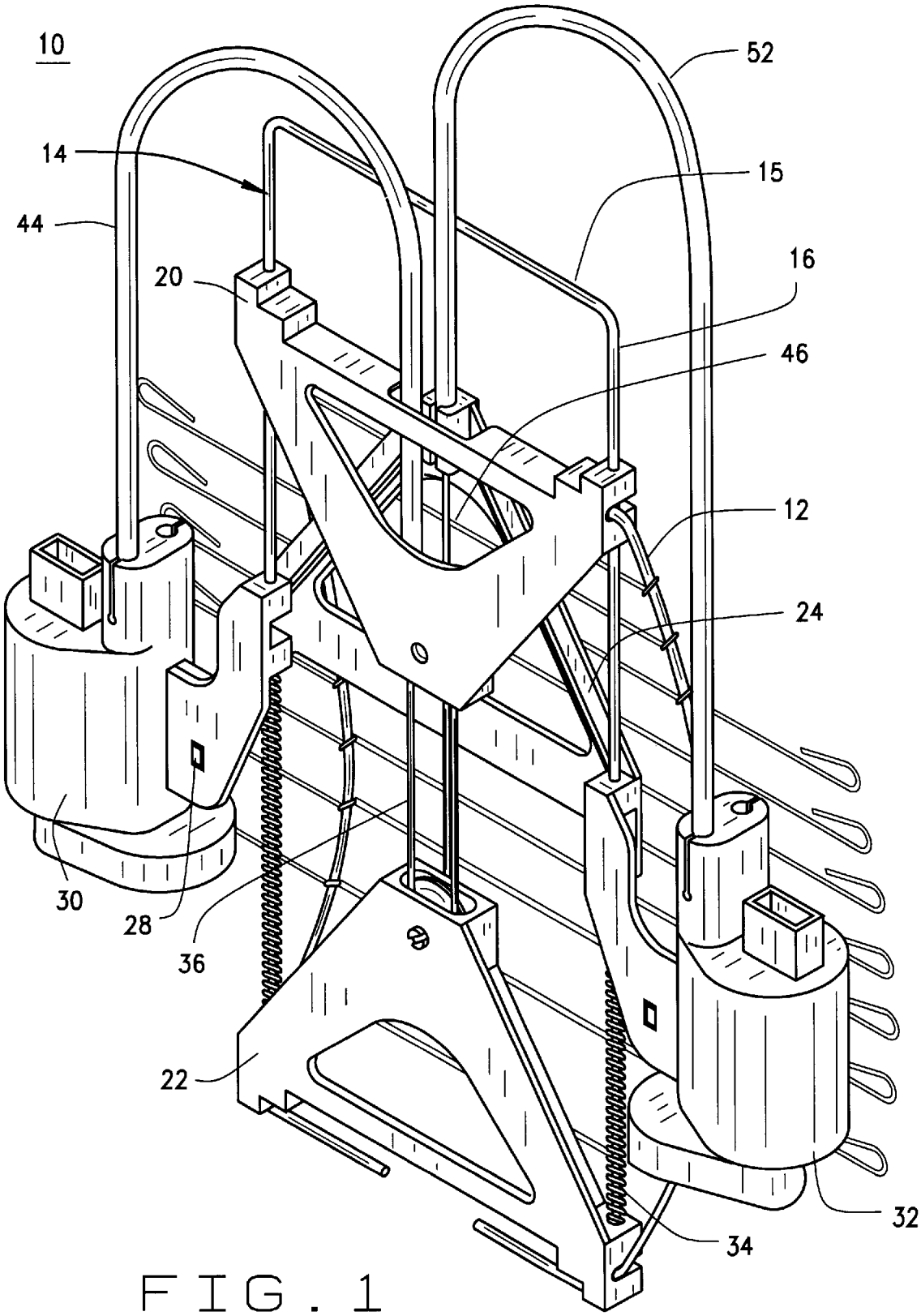
FIG. 1 illustrates a perspective view of a lumbar support device capable of axial location and curvature changes according to the present invention.
Figure 2:
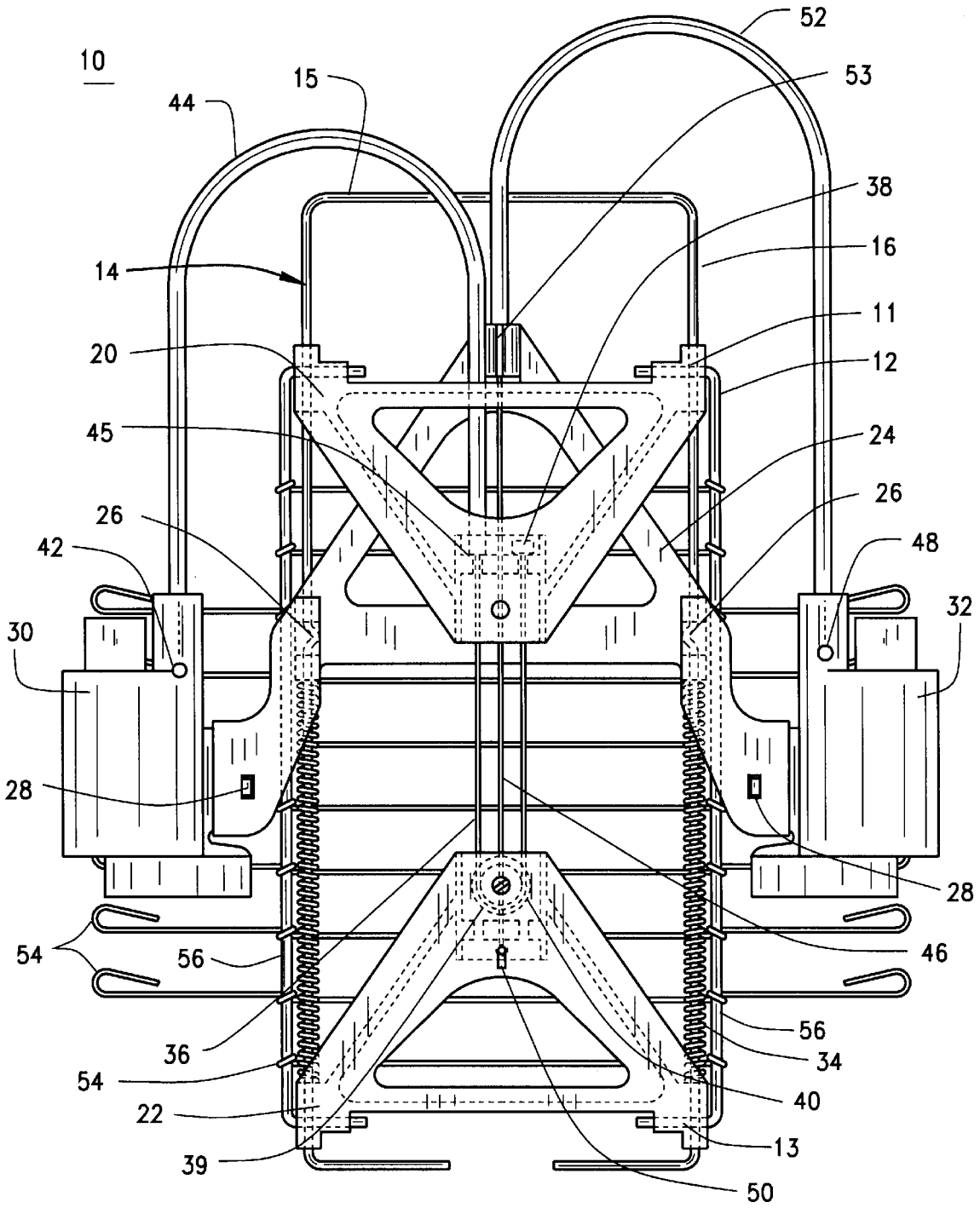
FIG. 2 illustrates a plan view of the lumbar support device in FIG. 1.

Referring to the accompanying drawings, FIGS. 1–5 illustrate a lumbar support device 10 according to the present invention, and according to this first embodiment, the device is capable of changing the axial position and curvature of a flexible grid 12. Referring specifically to FIG. 2, the basic framework of the device is built on a track 14, preferably a base wire 15 having substantially parallel sides 16. A pair of brackets slide along both sides of the base wire, and the brackets hold opposite ends of the flexible grid 12. More specifically, the first end 11 of the flexible grid 12 is attached to the first bracket 20, and the second end 13 of the flexible grid is attached to the second bracket 22. An integrated bracket 24 is held in place on the track 14 at a fixed position between the pair of brackets by a dimple 26, preferably with a dimple on each side of the base wire. The integrated bracket respectively holds a curvature cable actuator 30 and a spring cable actuator 32 on each side of the base wire, preferably with a snap-fit connection 28. The use of a snap-fit connection between the actuators and the integrated bracket minimizes the need for any hardware in the lumbar support unit. Also, a compression spring 34 slides over the track14, preferably on each side of the base wire 15, and is held in place between the integrated bracket 24 and the second bracket 22.

In addition to being attached to the flexible grid 12, the first bracket 20 is linked to the second bracket 22 by a curvature tension cable 36. Specifically, the curvature tension cable's terminal end 38 attaches to the first bracket 20 and its cable segment 39 wraps around a pulley 40 that is attached to the second bracket 22. To complete the linkages between the first bracket 20 and second bracket 22, the curvature tension cable's proximal end 42 is engaged by the curvature cable actuator 30, extending through a first bowden cable 44 to the first bracket 20. The sheath of the first bowden cable 44 is held in place at one end by a receiving end of the curvature cable actuator 30 and is secured to the first bracket 20 at the other end by a notch 45 formed in the first bracket. The integrated bracket 24 is linked to the second bracket 22 by a spring tension cable 46. The spring cable actuator 32 engages one end 48 of the spring tension cable 46, and a press-fit connection 50 secures the cable to the second bracket 22. The spring tension cable 46 has a second bowden cable 52 whose outer sheath is held in place between the receiving end of the spring cable actuator 32 and a notch 53 in the integrated bracket 24.

Figure 3:
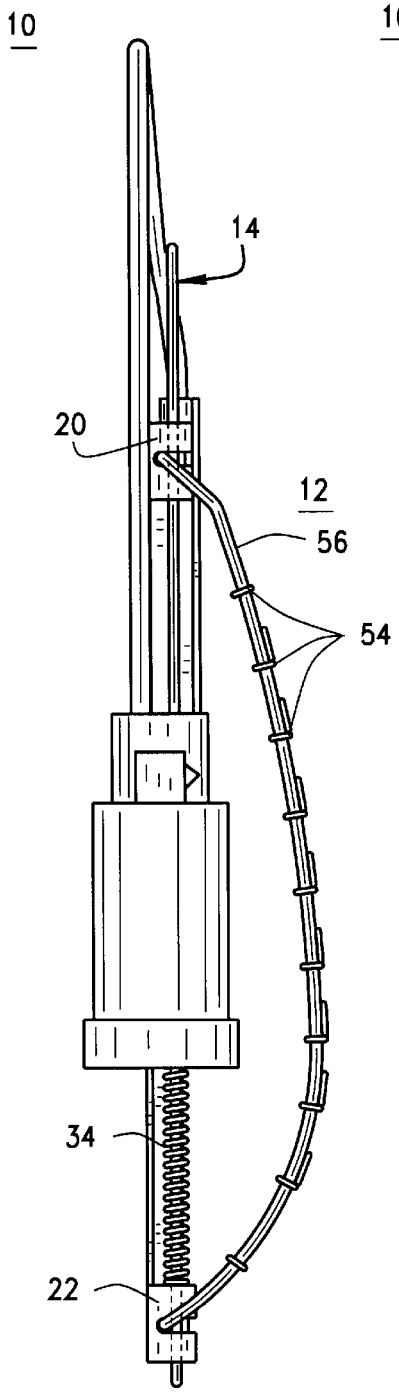
FIG. 3 illustrates a side elevation view of the lumbar support device in FIG. 1 having a given position for axial location and curvature.
Figure 4:
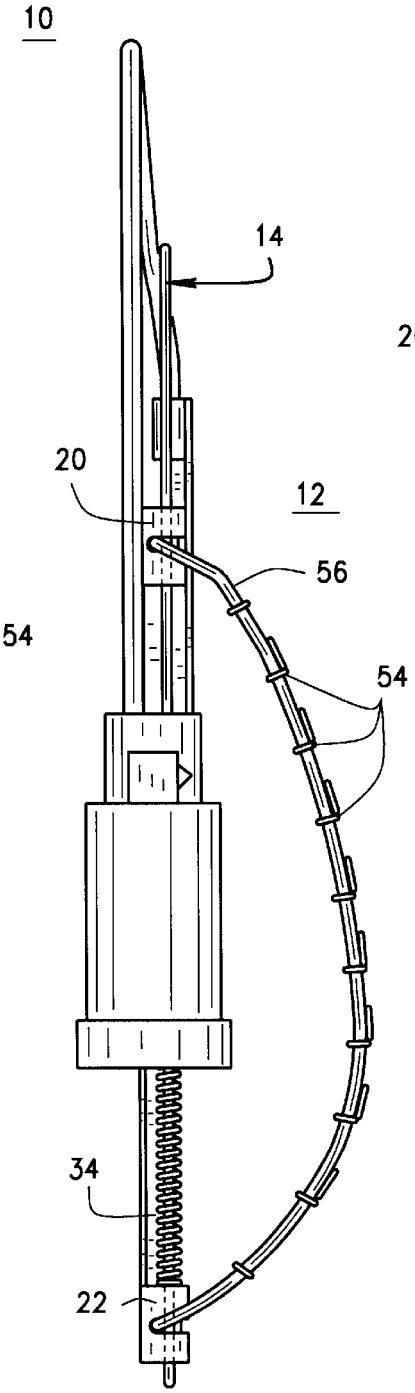
FIG. 4 illustrates another side elevation view of the lumbar support device in FIG. 1 having an alternate position to change the curvature.
Figure 5:
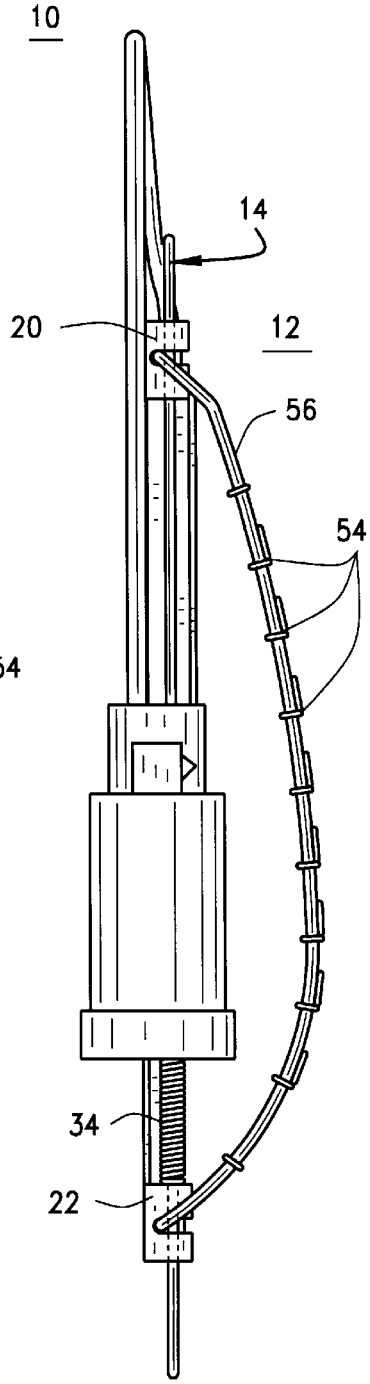
FIG. 5 illustrates a side elevation view of the lumbar support device in FIG. 1 having an alternate positions to change the axial location.

Referring also now to FIGS. 3, 4, and 5, the operation of the device is shown for both axial and curvature movement. To increase the curvature of the flexible grid 12, the curvature cable actuator 30 pulls on the proximal end 42 of the curvature tension cable 36, and its linear movement is transferred through the first bowden cable 44 to pull on the cable segment 39 joining the first bracket 20 to the second bracket 22. The length of the cable segment 39 is reduced causing the first bracket 20 and second bracket 22 to slide towards each other according to the mechanical advantage provided by the pulley 40. Each end of the flexible grid 12 is attached to the pair of brackets; therefore, as the distance between the brackets decreases the ends of the flexible grid are pulled together, resulting in the additional curvature of the flexible grid, specifically shown in FIG. 4.

The curvature tension cable 36 provides the tension necessary to bow the flexible grid 12, and the design of the flexible grid 12 provides resistance to being bowed. The flexible grid 12 has multiple flexible wires 54, and each wire's ends are securely wrapped around a pair of coated wires 56. It is the pair of coated wires 56 that actually bend and provide the bowing resistance. The multiple flexible wires 54 lie transverse to the bowing action and do not significantly contribute to the bowing resistance, but the stiffness of the multiple flexible wires force the coated wires 56 to bend in substantially parallel planes. Given the bowing resistance provided by the curvature of the flexible grid 12, reducing the curvature of the flexible grid 12 is achieved when the curvature cable actuator 30 lets out the proximal end 42 of the curvature tension cable 36.

To change the axial position of the flexible grid 12 in one direction, the spring cable actuator 32 pulls on one end 48 of the spring tension cable 46, and its linear movement is transferred through the second bowden cable 52 to the press-fit connection 50 of the spring tension cable 46, thereby pulling the second bracket 22 toward the integrated bracket 24. The pair of compression springs 34 provide increasing resistance as the distance between the second bracket 22 and the integrated bracket 24 decreases; a change in axial position is specifically shown in FIG. 5. To change the axial position of the flexible grid 12 in the other direction, the spring cable actuator 32 lets out the one end 48 of the spring tension cable 46. Absent any actuation of the curvature tension cable 46, the first bracket 20 and second bracket 22 slide in unison along the track, resulting in the linear movement of the flexible grid 12. For a given curvature of the flexible grid 12, it will be appreciated that the first bracket 20 is in a constrained relationship with the second bracket 22 due to the bowing resistance of the flexible grid and the length of the cable segment 39. Therefore, only one of the pair of brackets 20, 22 needs to be pulled relative to the integrated bracket 24 for the flexible grid 12 to be moved axially, such as pulling on the first bracket 20.

Various modifications could be made in the embodiment described and illustrated without departing from the scope of the invention. In particular, the use of the pulley 40 with the cable segment 39 provides the greatest mechanical advantage to achieve curvature movement with limited available power and a minimum number of parts. As discussed above, current methods suggest using a rod with a cable and either a lever or a groove. According to the present invention, less parts are necessary to obtain the mechanical advantage; only a cable segment 39 and a pulley 40 integrally incorporated into the second bracket 22. It will be readily apparent that the pulley 40 can be substituted with a pin or could even be fixed groove that is formed in the second 22 bracket without any rod. The cable segment 39 provides a mechanical advantage in bowing the flexible grid 12 by doubling the curvature tension cable 36 in linking the first bracket 20 with the second bracket 22.

As described above, a pair of motors drive the curvature cable actuator 30 and the spring cable actuator 32, respectively. Without departing from the invention, it is well known that these power units may be substituted with mechanical linkages, thereby allowing manual operation of the lumbar support device. It is anticipated that the use of a snap-fit connection between the actuators and the integrated bracket may be also be used for attaching manually powered mechanical linkages. Therefore, the use of drive motors is exemplary, and well known techniques may be used for manually operating the lumbar support device according to the present invention.

Yet another modification could be made to the attachment of the flexible grid 12 to the pair of brackets without departing from the invention. As described and illustrated, the ends of the flexible grid are rotatably attached to the pair of brackets. The ends of the flexible grid could be fixedly attached to the pair of brackets as suggested by current methods. However, the rotation reduces the force necessary to bow the flexible grid and allows for more curvature than could be obtained had the ends of the flexible grid been fixedly attached to the pair of brackets. In a rigid attachment, the bowing of the flexible grid is inhibited at its ends by a constrained angle.

Figure 6:
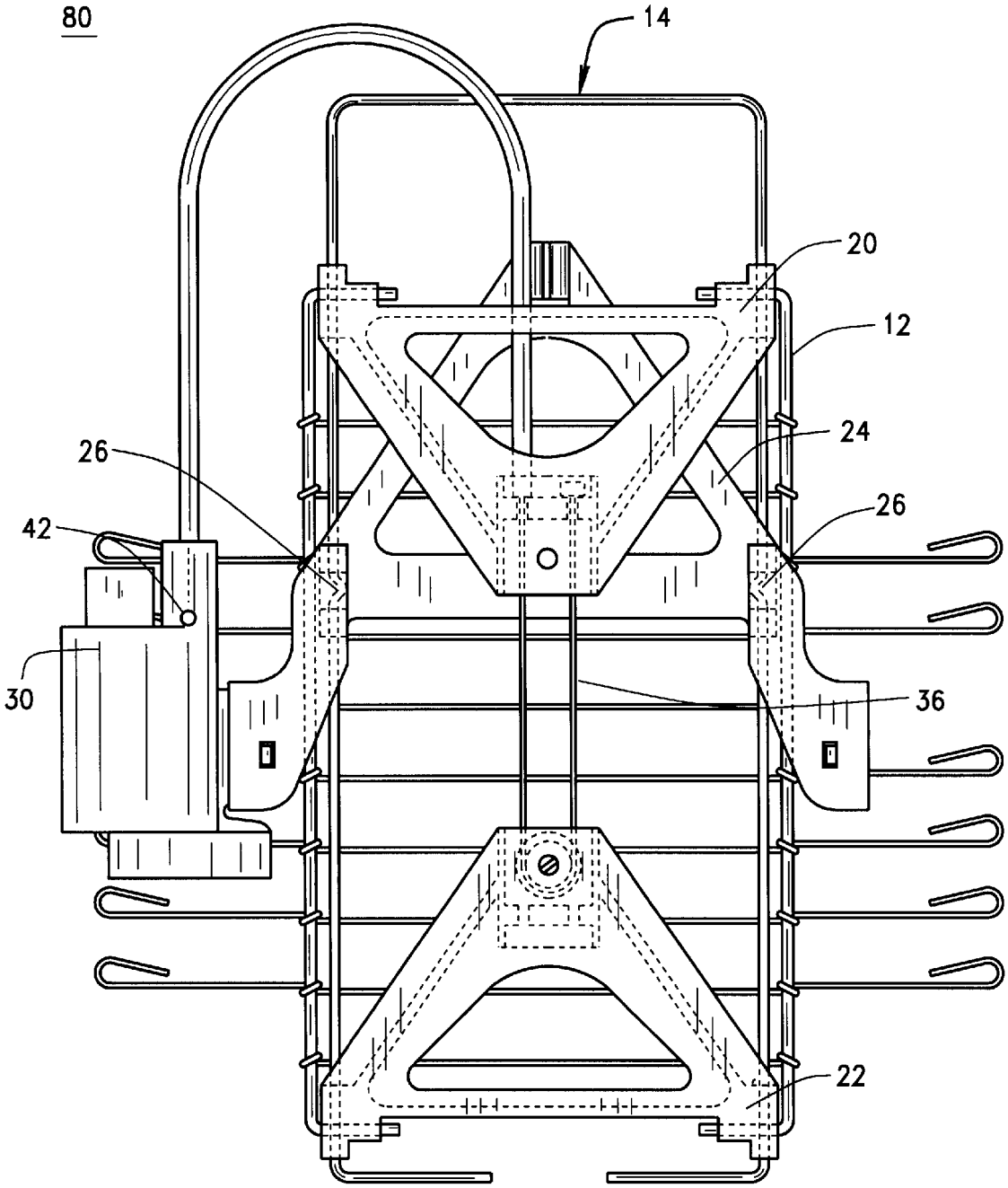
FIG. 6 illustrates a plan view of a lumbar support device capable of curvature movement alone according to another embodiment of the present invention.

According to a second embodiment of the present invention, the lumbar support device 80 can change the curvature of a flexible grid 12 that is constrained to a single axial position. Referring specifically to FIG. 6, similarities with the first embodiment are found in the construction and operation of the device. The pair of brackets slide along the track 14 and hold opposite ends of the flexible grid 12. The integrated bracket 24 slides onto the track between the pair of brackets and is held in place by a dimple 26 at a fixed position on the track. Prior lumbar support devices capable of curvature movement required hardware for attaching a bracket to a track or, according to the patents incorporated by reference, held a bracket between a dimple and a bend. According to the present invention, the dimple can be formed in the track during automated assembly operations without the need for any hardware to attach the integrated bracket to the track and without the need to form a bend in the track to hold the integrated bracket in place.

As in the first embodiment, the first bracket 20 is linked to the second bracket 22 by a curvature tension cable 36 using a press-fit connection 50, and the curvature tension cable's proximal end 42 is engaged by the curvature cable actuator 30. In this embodiment, the integrated bracket 24 only holds the curvature cable actuator 30. The compression springs, spring cable actuator, and spring tension cable that were in the first embodiment are not necessary in this embodiment.

Similar to the first embodiment, the curvature of the flexible grid 12 is determined by the curvature cable actuator 30 pulling on the curvature tension cable 36 and the resistance of the flexible grid pushing back from the bowed position. In the second embodiment, both of the brackets do not need to slide on the track 14, and it may be desirable to fix either the first bracket 20 or the second bracket 22, allowing only one of the pair of brackets to move. The operation of the curvature tension cable 36 and the resulting curvature of the flexible grid 12 remain identical to the first embodiment.

Figure 7:
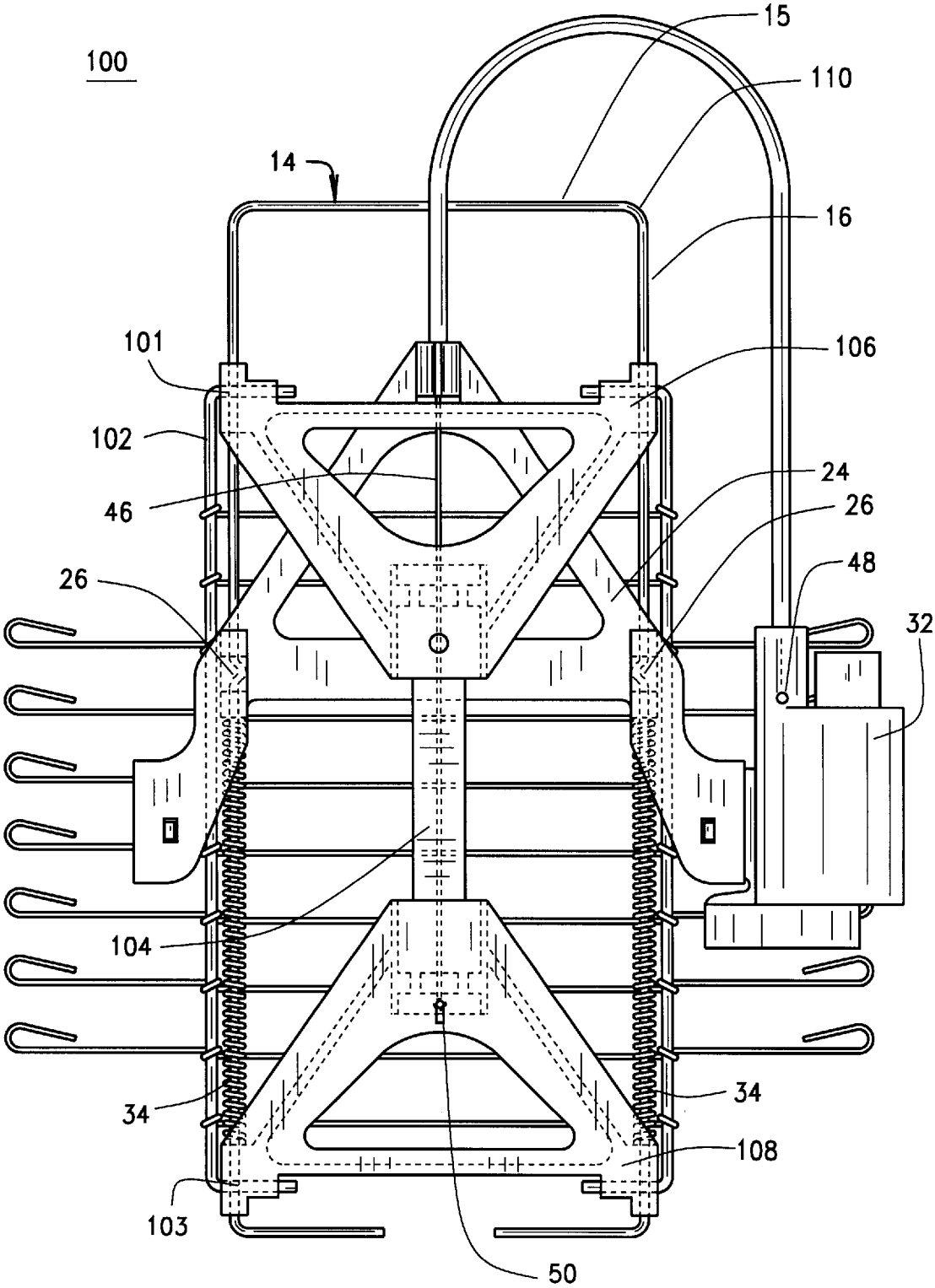
FIG. 7 illustrates a plan view of a lumbar support unit capable of axial movement alone according to yet another embodiment of the present invention.

According to a third embodiment of the present invention, the lumbar support device 100 can change the axial position of a grid 102 that is constrained to a single curvature. Referring specifically to FIG. 7, similarities with the first embodiment are found in the construction and operation of the device. Since the curvature of the grid 102 is not adjusted in this embodiment, a pair of brackets is not necessary and may be substituted with a bracket of unitary construction 104 that slides along the track 14; additionally, the grid 102 does not need to be flexible. The unitary bracket 104 has a first end 106 that holds the first end 101 of the grid 102 and a second end 108 that holds the second end 103 of the grid 102 on either side of the integrated bracket 24. In this embodiment, the spring tension cable 46 links the integrated bracket 24 with the unitary bracket 104, and the compression springs 34 fit around the track 14 between the integrated bracket and the second end 108 of the unitary bracket. As in the first embodiment, the track 14 holds the integrated bracket in place by a dimple 26, and the integrated bracket 24 holds the spring cable actuator 32. The pulley, curvature cable actuator, and curvature tension cable that were in the first embodiment are not necessary in this embodiment. Similar to the first embodiment, the axial position of the grid is determined by the spring cable actuator 32 pulling on the spring tension cable 46 and the resistance of the compression springs 34 pushing in an opposite direction.

In the third embodiment, the compression springs 34 do not need to be held between the second end 108 of the unitary bracket 104 and the integrated bracket 24. Without departing from the invention, the compression springs 34 can be held in place between the first end 106 of the unitary bracket 104 and a bend 110 in the base wire 15. Prior lumbar support devices capable of axial movement suggest using push rods and extension springs and other hardware that generally require some manual assembly operations. According to the present invention, the sides of the base wire can be automatically fed through the compression springs 34 that are easily held by assembly equipment. As in the prior two embodiments, the dimple 26 can be formed in the track during automated assembly operations without the need for any hardware to attach the integrated bracket to the track and without the need to form a bend in the track to hold the integrated bracket in place.

According to the description of the preferred embodiments above, the track can be constructed from a base wire. The use of a base wire as a track is known to be well suited to automatic manufacturing operations and generally simplifies the assembly process. The base wire has a closed end and substantially parallel sides that form an open end. According to the patents incorporated by reference, it is known to slidably attach a bracket onto the open end of the base wire through apertures in the bracket and hold the bracket onto the base wire with bends in the base wire (a slidably-attached bend-held bracket), to secure a bracket to the base wire between a dimple and a bend in the base wire, and to rotatably attach the flexible grid to a pair of brackets with a pair of pivot legs formed on each end of the border elements (or coated wires). Each of these attachments is accomplished using corresponding formations in the structures themselves, thereby eliminating any need for a weld, a rivet, or any other hardware. According to a simplified assembly process of the present invention, an integrated bracket slides onto a track and is secured to the track by a dimple at a fixed position in the track, a compression spring slides onto the track and is held in place between the integrated bracket and a slidably-attached bend-held bracket, and the integrated bracket is linked with the second bracket using a press-fit connection at the end of the spring tension cable. No hardware is required to hold each of these elements to the track or in relationship to each other, and the simplified assembly process is well suited for automated manufacturing operations. For a powered lumbar support, the assembly process can be further simplified by attaching the actuators to the integrated bracket through respective snap-fit connections.

The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, the cable segment may be used with the pulley or the pin, or a groove in the second bracket, to perform substantially the same function in substantially the same way to produce the same result, and the pulley, pin, and groove are particularly described as equivalent structural elements. Thus, the breadth and scope of the present invention should not be limited by any of the above-described exemplary embodiments, but should be defined only in accordance with the following claims appended hereto and their equivalents.

What is claimed is:

1. A lumbar support device capable of curvature movement, comprising:

a track;

a pair of brackets attached to the track wherein at least one of the pair of brackets is slidably attached to the track such that a first bracket is movable with respect to a second bracket;

a flexible grid attached between the pair of brackets;

a curvature tension cable having a proximal end extending through a bowden cable, a terminal end attached to the first bracket, and a cable segment linking the first bracket with the second bracket, the bowden cable being secured at a notch in the first bracket; and a curvature cable actuator engaging the proximal end of the curvature tension cable.

2. A lumbar support device according to claim 1, further comprising a pulley wrapped by the cable segment and attached to the second bracket.

3. A lumbar support device according to claim 1, wherein the track further comprises a base wire having a dimple at a fixed location.

4. A lumbar support device according to claim 3, further comprising an integrated bracket secured to the base wire and held at the fixed location by the dimple.

5. A lumbar support device according to claim 4, further comprising a snap-fit connection between the curvature cable actuator and the integrated bracket.

6. A lumbar support device capable of axial movement, comprising:

a track;

a unitary bracket slidably attached to the track;

a grid attached to the unitary bracket;

an integrated bracket secured to the track at a fixed location;

a spring tension cable linking the integrated bracket with the unitary bracket;

a compression spring surrounding the track; and a spring cable actuator engaging the spring tension cable.

7. A lumbar support device according to claim 6, further comprising a snap-fit connection between the spring cable actuator and the integrated bracket.

8. A lumbar support device according to claim 6, wherein the track further comprises a base wire having substantially parallel sides with a dimple at the fixed location for holding the integrated bracket in place.

9. A lumbar support device according to claim 8, wherein the compression spring comprises a pair of compression springs surrounding the sides of the base wire and situated between the integrated bracket and the unitary bracket.

10. A lumbar support device according to claim 8, wherein the compression spring comprises a pair of compression springs surrounding the sides of the base wire and situated between the unitary bracket and a bend in the base wire.

11. A lumbar support device according to claim 6, wherein the unitary bracket further comprises a first bracket slidably attached to the track and a second bracket slidably attached to the track.

12. A lumbar support device capable of axial and curvature movement, comprising:

a track;

a pair of brackets slidably attached to the track such that a first bracket is movable with respect to a second bracket and the pair of brackets is movable with respect to the track;

a flexible grid attached between the pair of brackets; an integrated bracket secured to the track at a fixed location;

a curvature tension cable having a proximal end, a terminal end attached to the first bracket, and a cable segment linking the first bracket with the second bracket;

a curvature cable actuator engaging the proximal end of the curvature tension cable; and an axial movement means for sliding the first bracket and second bracket relative to the integrated bracket, thereby changing the axial location of the flexible grid.

13. A lumbar support device according to claim 12, further comprising a pulley wrapped by the cable segment and attached to the second bracket.

14. A lumbar support device according to claim 12, wherein the track further comprises a base wire having substantially parallel sides with a dimple at the fixed location for holding the integrated bracket in place.

15. A lumbar support device according to claim 14, in which the axial movement means comprises:

a spring tension cable linking the integrated bracket with the second bracket;

a spring cable actuator engaging the spring tension cable; and a pair of compression springs surrounding the sides of the base wire and situated between the integrated bracket and the second bracket.

16. A lumbar support device according to claim 15, wherein the curvature cable actuator is attached to the integrated bracket through a snap-fit connection and the spring cable actuator is attached to the integrated bracket through a snap-fit connection.

17. A lumbar support device according to claim 15, wherein the spring cable actuator engages the spring tension cable through a second bowden cable, the second bowden cable is secured at a notch in the integrated bracket, and the spring tension cable extends through the second bowden cable and is secured to the second bracket with a press-fit connection.

18. A simplified method of assembling a lumbar support device, comprising the steps of:

sliding a pair of brackets onto a track having an open end such that a first bracket is movable with respect to a second bracket;

attaching a flexible grid to the pair of brackets;

sliding an integrated bracket onto the track between the pair of brackets;

sliding a compression spring onto the track between the integrated bracket and the second bracket;

forming a dimple at a fixed location on the track to secure the integrated bracket to the fixed location;

forming a bend at the open end of the track to close the open end; and linking the integrated bracket to the pair of brackets with an axial movement means.

19. A simplified method of assembling a lumbar support device according to claim 18, further comprising the steps of:

snap-fitting a spring cable actuator to the integrated bracket;

securing a first end of a spring tension cable to the spring cable actuator; and securing a second end of the spring tension cable to the second bracket with a press-fit connection, the spring tension cable running through a bowden cable secured between the spring cable actuator and the integrated bracket.

20. A simplified method of assembling a lumbar support device according to claim 18 further comprising the steps of:

snap-fitting a curvature cable actuator to the integrated bracket;

securing a proximal end of a curvature tension cable to the curvature cable actuator; and securing a terminal end of the curvature tension cable to the first bracket, the spring tension cable running through a bowden cable secured between the curvature cable actuator and the first bracket, and a cable segment running between the terminal end and the bowden cable.

* * * * *